United States Patent [19]

Brewer

[11] 4,361,476

[45] Nov. 30, 1982

[54] PROCESS AND APPARATUS FOR RECOVERY OF OIL FROM TAR SANDS

[75] Inventor: John C. Brewer, Salt Lake County, Utah

[73] Assignee: Garb-Oil Corporation of America, Salt Lake City, Utah

[21] Appl. No.: 237,442

[22] Filed: Feb. 23, 1981

[51] Int. Cl.[3] ..... C10G 1/04
[52] U.S. Cl. ..... 208/11 LE
[58] Field of Search ..... 208/11 LE

[56] References Cited

U.S. PATENT DOCUMENTS

| | | | |
|---|---|---|---|
| 2,453,060 | 11/1948 | Bauer et al. | 208/11 LE |
| 2,670,317 | 2/1954 | Adams | 208/11 LE |
| 2,910,424 | 10/1959 | Tek et al. | 208/11 LE |
| 2,968,603 | 1/1961 | Coulson | 208/11 LE |
| 3,081,027 | 3/1963 | Coulson | 208/11 LE |
| 3,560,371 | 2/1971 | Kaminski | 208/11 LE |
| 3,660,268 | 5/1972 | Kelly | 208/11 LE |
| 3,814,336 | 6/1974 | Brewer | 241/79.1 |

FOREIGN PATENT DOCUMENTS

| | | | |
|---|---|---|---|
| 586229 | 11/1959 | Canada | 208/11 LE |

*Primary Examiner*—Charles F. Warren
*Assistant Examiner*—Joseph A. Boska
*Attorney, Agent, or Firm*—Mallinckrodt & Mallinckrodt

[57] ABSTRACT

A crude oil product is extracted from a tar sand by first crushing the tar sand as mined and then fine grinding the crushed material in a grinding mill in the presence of a cleansing liquid, such as an aqueous solution of a caustic. The resulting slurry is passed into suitable extractor-classifier equipment, such as that shown in U.S. Pat. No. 3,814,336, in which a body of cleansing liquid is maintained. Agitation of the slurry in such maintained body of cleansing liquid substantially completes removal of the bituminous matter from the sand, and the resulting crude oil and cleansing liquid phase is discharged separately from the sand solid phase. The liquid phase is treated for the removal of residual sand particles and for the separation of residual cleansing liquid from the crude oil. The cleansing liquid so recovered is recycled and the crude oil is passed to further processing or for use as such.

4 Claims, 1 Drawing Figure

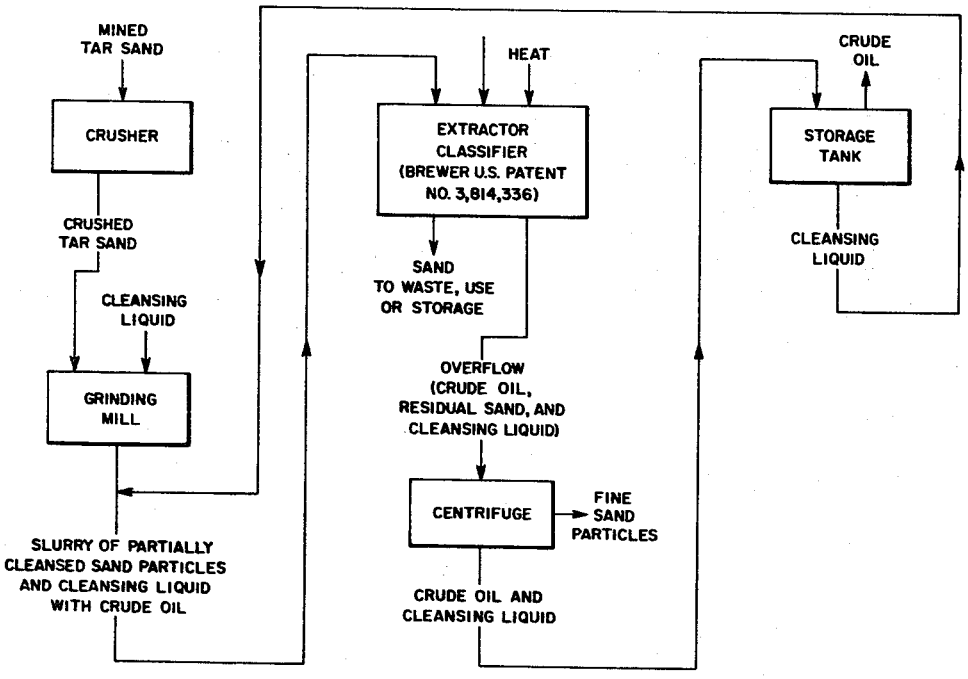

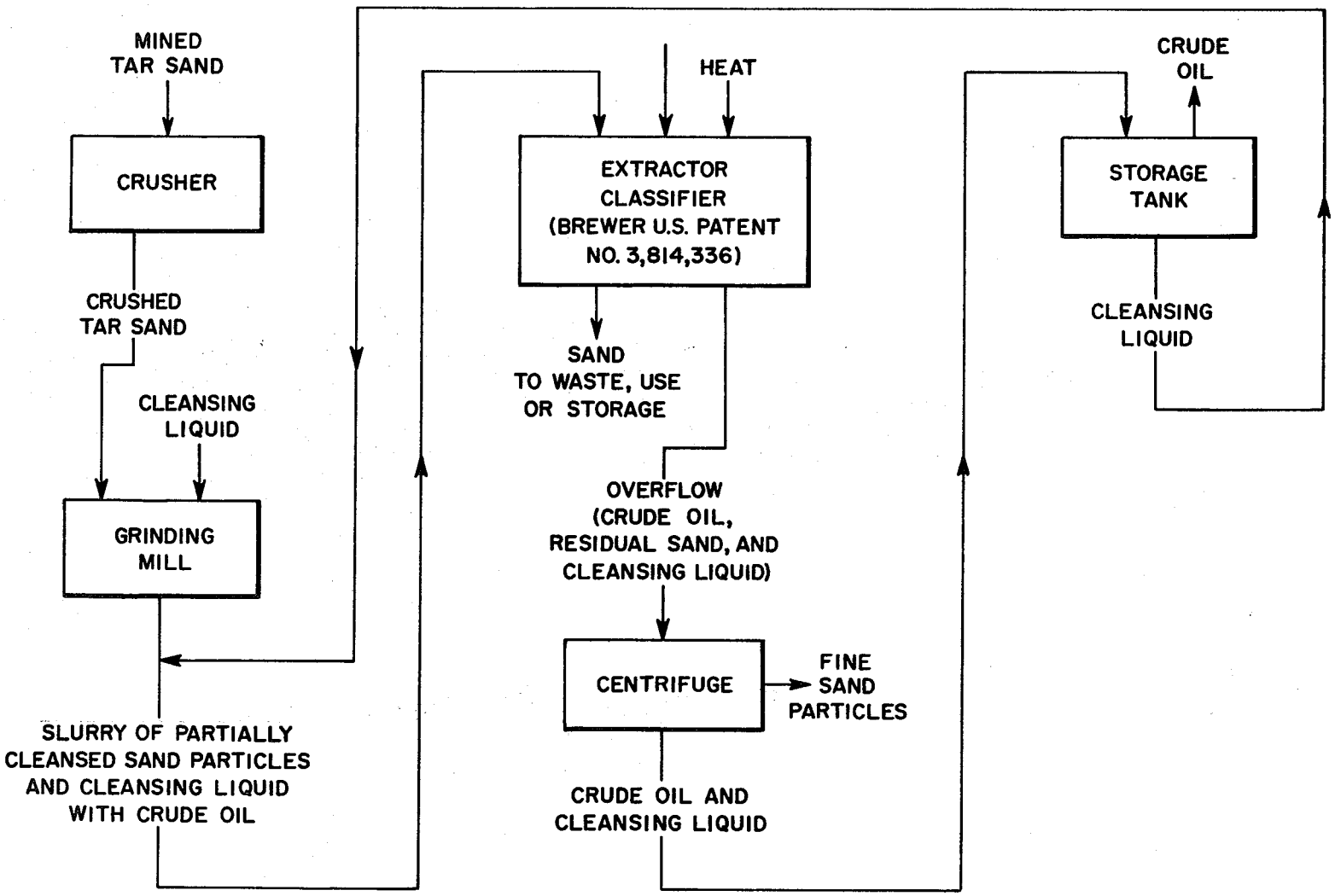
MINED TAR SAND
CRUSHER
CRUSHED TAR SAND
CLEANSING LIQUID
GRINDING MILL
SLURRY OF PARTIALLY CLEANSED SAND PARTICLES AND CLEANSING LIQUID WITH CRUDE OIL
HEAT
EXTRACTOR CLASSIFIER (BREWER U.S. PATENT NO. 3,814,336)
SAND TO WASTE, USE OR STORAGE
OVERFLOW (CRUDE OIL, RESIDUAL SAND, AND CLEANSING LIQUID)
CENTRIFUGE
FINE SAND PARTICLES
CRUDE OIL AND CLEANSING LIQUID
CRUDE OIL
STORAGE TANK
CLEANSING LIQUID

PROCESS AND APPARATUS FOR RECOVERY OF OIL FROM TAR SANDS

BACKGROUND OF THE INVENTION

1. Field

The invention is concerned with the treatment of tar sands and the like for extraction and recovery of oil therefrom.

2. State of the Art

Economical recovery of oil from tar sands, which occur in abundance in both the United States of America and Canada, has long been desired. A variety of processes have been proposed; yet few have been commercially successful. A primary objective of the present invention was to provide a commercially practical method of and apparatus for handling tar sands and for extracting and recovering oil therefrom.

SUMMARY OF THE INVENTION

In accordance with the invention, tar sand from a deposit of same is crushed, as by means of a standard jaw crusher, and is charged into a suitable grinding mill such as a ball or rod mill into which is also fed a cleansing liquid, e.g. an aqueous solution of a caustic, for removing the bituminous matter carried by such sand. During grinding of the tar sand in the mill, it is subjected to the action of the cleansing liquid, which tends to separate the organic bituminous matter from the inorganic sand with which it is intimately associated in its natural state. It is preferred that additional cleansing liquid be introduced into the finely ground sand slurry as it is discharged from the mill and charged into preferably a special type of extraction classifier where heat is applied and the crude oil and cleansing liquid phase is separated from the sand solid phase and the two phases are separately discharged. The liquid phase is passed through a centrifuge for the elimination of any residual sand particles from the crude oil, and is then subjected to any suitable procedure for separating the crude oil component from the residual cleansing liquid component, e.g. is passed directly into a storage tank or tanks for gravity separation of the two liquid components. The crude oil product is further processed, used, or stored for use, and the residual cleansing liquid is recycled. The fine sand particles from the classifier may be passed to waste or to some point of use or of storage for subsequent use.

THE DRAWING

The best mode presently contemplated for carrying out the invention is shown in the accompanying drawing in which the single FIGURE is a flow sheet indicative of the several steps of the process.

DETAILED DESCRIPTION OF THE ILLUSTRATED EMBODIMENT

The preferred procedure shown by the flow sheet of the drawing comprises the steps of crushing a natural tar sand, as mined, by the use of any suitable type of crusher, e.g. a standard jaw crusher; passing the crushed tar sand to a grinding mill, preferably a ball or rod mill; and grinding the crushed tar sand in the presence of a cleansing liquid, such as an aqueous solution of caustic soda, for removing much of the bituminous matter from the sand. It should be realized that the cleansing liquid could be any solvent for the bituminous matter found to be commercially economical to use.

The resulting slurry is discharged from the grinding mill into an extractor classifier, corresponding to that shown and described in my U.S. Pat. No. 3,814,336, issued June 4, 1974, where further removal of bituminous matter from the sand is accomplished and the resulting crude oil and cleansing liquid phase is separated from the sand solid phase. The extractor classifier includes a hydropulper type of extractor wherein a rotary cylindrical shell agitator shares, at a substantially common level, a body of cleansing liquid with an immediately succeeding and conjoined classifier having a sink-float settlement tank with an overflow discharge at the surface of the body of liquid and having means for elevating the sink component through the body of liquid to a separate discharge therefor adjacent to the surface of the body of liquid.

The two phases, liquid float and solid sink, are separately discharged from the extractor classifier, and the liquid phase is passed to a centrifuge where residual fine sand articles are separated from the crude oil and cleansing liquid.

The crude oil may be separated from the cleansing liquid in any suitable manner, but preferably the unseparated liquid material is passed to a storage tank or tanks for gravity separation while awaiting withdrawal of the separated liquids, the crude oil being held as a product for further processing and the cleansing liquid being held for recycling into the slurry discharge from the grinding mill or into the extractor classifier or into both.

Equipment substantially corresponding to that of my U.S. Pat. No. 3,814,336 is preferred for the extractor classifier, since the revolving material-input drum of such equipment agitates the tar sand slurry as it passes through, and deeply into, a maintained body of cleansing liquid, which may be the same as or different from that used in the grinding mill, for example, initially hot water or a mineral spirits solvent as contrasted with an aqueous solution of a caustic as preferably used in the grinding mill. The crude oil rises in the maintained body of cleansing liquid and discharges with the overflow therefrom intermediate the length of the classifier vessel, while the sand sinks and is discharged at the far end of such vessel by the auger that extends along the upwardly sloping bottom of the vessel.

In the use of such equipment, the maintained body of cleansing liquid is continuously or intermittently heated in any suitable manner, for example by mounting heaters against the outside surfaces of the walls of the classifier vessel, which will be made of a heat-transmitting material such as sheet steel.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A process for recovering oil from tar sands, comprising the steps of crushing a natural tar sand as mined; fine grinding the crushed tar sand in a ball or rod mill in the presence of a cleansing liquid, for producing a crude oil, cleansing liquid, and sand slurry; passing said slurry into an extractor classifier means which comprises a hydropulper type of extractor having a rotary cylindrical shell agitator, and a sink-float type of classifier having a sink-float tank means joined with said shell for sharing therewith, at substantially a common level, a body of cleansing liquid, said tank having liquid-overflow discharge means at substantially said level and means for elevating solids from the tank bottom to discharge adjacent to said level; agitating said slurry and the contained portion of said body of cleansing liquid in the agitator portion of the extractor classifier while passing the slurry into the sink-float tank means of the classifier portion thereof; overflowing crude oil and cleansing liquid from said tank as a float product; discharging sand from said tank means as a sink product; separating residual sand particles from said float product; and separating the crude oil in said float product from the cleansing liquid therein.

2. A process according to claim 1, wherein the cleansing liquid is an aqueous solution of a caustic.

3. A process according to claim 1, wherein the body of cleansing liquid is heated.

4. A process according to claim 1, wherein residual sand particles are separated from the crude oil float product by centrifuging.

* * * * *